US005577395A

United States Patent [19]

Kuykendall

[11] Patent Number: 5,577,395

[45] Date of Patent: Nov. 26, 1996

[54] CLIP FOR AN IDENTIFICATION BRACELET

[75] Inventor: Dennis C. Kuykendall, Clarkesville, Ga.

[73] Assignee: Scovill Fasteners Inc., Clarkesville, Ga.

[21] Appl. No.: 433,750

[22] Filed: May 4, 1995

[51] Int. Cl.[6] ..... A44C 5/00

[52] U.S. Cl. ..... 63/3; 24/355; 24/543; 40/633; 292/317

[58] Field of Search ..... 24/355, 543, 703.1; 40/633; 63/3; 292/307 A, 317, 325

[56] References Cited

U.S. PATENT DOCUMENTS

| | | | |
|---|---|---|---|
| 3,323,208 | 6/1967 | Hurley, Jr. | 606/120 |
| 3,645,023 | 2/1972 | Larson | 40/633 |
| 3,729,780 | 5/1973 | White | 24/704.2 |
| 3,744,104 | 7/1973 | Ford | 24/543 |
| 3,800,450 | 4/1974 | Laugherty et al. | 40/633 |
| 3,823,443 | 7/1974 | Takabayashi | 24/543 X |
| 4,038,726 | 8/1977 | Takabayashi | 24/198 |
| 4,356,599 | 11/1982 | Larson et al. | 24/16 PB |
| 4,378,617 | 4/1983 | Burns | 24/336 |
| 4,821,789 | 4/1989 | Van Rens | 24/543 X |
| 4,897,900 | 2/1990 | Baggett | 24/6543 |
| 4,983,047 | 1/1991 | Netto | 383/5 |
| 5,046,875 | 9/1991 | Skolnik | 401/49 |
| 5,176,106 | 1/1993 | Casto et al. | 119/865 |
| 5,313,721 | 5/1994 | Filden | 40/1.6 |

FOREIGN PATENT DOCUMENTS

| | | | |
|---|---|---|---|
| 1346793 | 2/1974 | United Kingdom | 40/633 |
| 91/18955 | 12/1991 | WIPO | 63/3 |

*Primary Examiner*—Blair Johnson
*Assistant Examiner*—Andrea Chop
*Attorney, Agent, or Firm*—Dallett Hoopes

[57] ABSTRACT

A one-piece plastic clip comprises a base plate and a cover plate with a living hinge inbetween. In pre-assembly the plates are held widely open by a temporary unitary strut. The bracelet strap is attached to the base plate by having apertures formed in the strap receive bushings in the base plate which are then flared outwardly to "rivet" the parts together. The struts are then sheared away, and the cover plate is freely hinged. In the final assembly the strap encircles the patient's wrist and the cover plate is brought down over the base plate, pointed projections on the cover plate piercing the free end of the strap and entering the bushings, and staggered ribs augmenting the gripping. The cover plate is then latched closed against the base plate.

3 Claims, 3 Drawing Sheets

CLIP FOR AN IDENTIFICATION BRACELET

BACKGROUND OF THE INVENTION

This invention relates to a securing clip for a name-bearing identification bracelet as used in hospitals. More specifically, this invention relates to a plastic one-piece hinged clip having cooperant pointed projections and holes so that the clip may be closed over the free end of the I.D. bracelet strap to pierce it and hold it securely.

SUMMARY OF THE INVENTION

In the past hospital I.D. bracelets have comprised a plastic strap which has been either a single plastic layer or a flattened plastic tube held by a metal clip, the clip being preassembled at one end of the strap. The clip has been closable to grasp and pinch the free end of the strap after circumposing the wrist or ankle so that it has been held secure against accidental opening or tampering.

The art has included hinged plastic clips wherein two hinged-together plates have been latchable opposite the hinge to clamp therebetween fabric or other material. An example is shown in U.S Pat. No. 3,744,104 to Ford issued Jul. 10, 1973 which pierces one end of the bracelet but uses a clamping connection with the other end relying on a frictional engagement. Another clamp is disclosed in U.S. Pat. No. 4,897,900 to Baggett issued Feb. 6, 1990. Other hinged one-piece plastic clamps have included pointed projections adapted to pierce the material, an example being shown in the Hurley, Jr. U.S. Pat. No. 3,323,208 issued Jun. 6, 1967. A further example is disclosed in the Takabayashi U.S. Pat. No. 4,038,726 issued Aug. 2, 1977 wherein a one-piece plastic clamp comprises spaced projections adapted to pierce tissue. Also included are staggered ribs adapted to securely hold the tissue when the clip is latched closed.

There has been a need for a simple plastic clip for a hospital I.D. bracelet which is X-ray transparent and which pierces both ends of the bracelet as well as clamps them, holding them together in a secure, positive way, not susceptible to accidental opening or tampering.

SUMMARY OF THE INVENTION

The present invention envisions a one-piece hinged plastic clip comprising a base plate and a cover plate. In preassembly the plates are held open by a temporary strut unitary with the plates. The base plate has upstanding bushings which engage pre-made apertures in the strap. These bushings are then upset by being forced to flare outwardly to secure the strap and clip together. The struts are sheared off, and the cover plate is freely hinged. In the final assembly in the hospital the strap is encircled about the patient's wrist and the cover plate is brought down over the base plate, the pointed projections on the cover plate piercing the free end of the strap and entering the hole in the upset bushings. The cover plate is then latched closed against the base plate to hold the unit securely on the patient.

BRIEF DESCRIPTION OF THE DRAWINGS

Other objects and features of the invention will be apparent from the following specification and the accompanying drawings, all of which disclose a non-limiting form of the invention. In the drawings.

DESCRIPTION OF THE PREFERRED EMBODIMENTS

Figure 1:
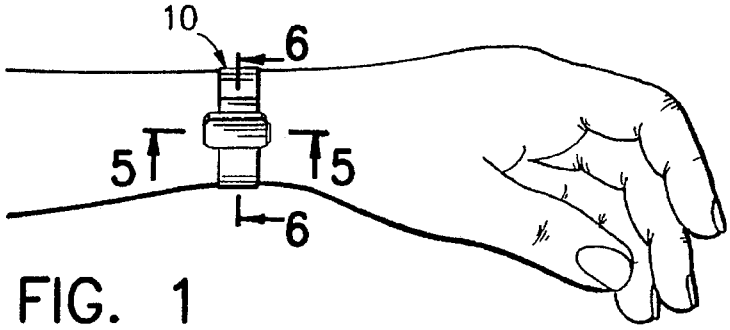
FIG. 1 shows a bracelet embodying the invention as applied to a patient's wrist.

An I.D. bracelet having a clip embodying the invention is shown in FIG. 1 and generally designated 10. It comprises (FIG. 2) a clip 12 and a length of a strap 14, both entirely of plastic. The clip is preferably molded from plastic, for instance, Nylon or an acetal.

The clip comprises a base plate 16 and a cover plate 18 hinged together by a unitary living hinge 20. The base plate is formed with an inside surface 22 and the cover plate is formed with an inside surface 24.

The plates are each generally rectangular and in length and width are roughly comparable to each other, the cover plate being somewhat larger. The base plate as shown is formed with a peripheral upward lip 26 which is relieved on its lengthwise runs as at 28 to permit passage of the strap 14. The cover plate is formed with a lip 30 which is relieved at the hinge end and notched at the distal end as at 32 for molding purposes.

Diagonal hold-open struts 34 on opposite sides of the hinge extend from the inner surface 24 of the cover plate to the lip 26 to hold the plates in flat open condition during pre-assembly. The struts 34 are frangible and are sheared at pre-assembly.

The base plate 12 is formed with a longitudinal rib 36. Spaced along its length the rib is apertured as at 38 (FIG. 5), the apertures extending upwardly from the rib in annular lips or bushings 40 unitary with the plate. The rib is formed with an upward positioning curb 42 remote from the hinge, and a downwardly inclined latching flap 44 is formed in an opening 46 inwardly of the lip 26.

Figure 6:
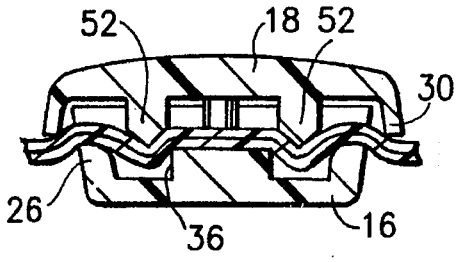
FIG. 6 is a greatly enlarged sectional view taken on the line 6—6 of FIG. 1.

Unitary with the cover plate 18 are a pair of pointed projections 50 which are adapted when the cover plate 18 is pivoted about hinge 20 to enter the holes 38 respectively by way of the bushings 40. Spaced outward from the projections are the longitudinal pointed ribs 52 which, in closing, bestride the rib 36 (FIG. 6).

A latching bolt 54 (FIG. 5) is unitarily formed up from the inside 24 of the cover plate and its upper end is hooked outward as at 56. The opposite side of the bolt is formed with a lead-in chamfer.

Figure 5:
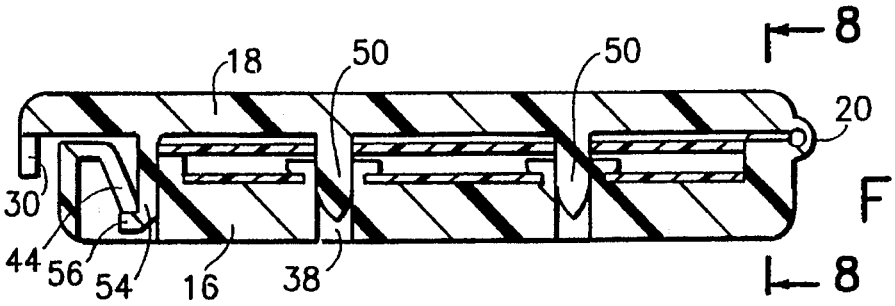
FIG. 5 is a greatly enlarged sectional view on the line 5—5 of FIG. 1.

In pre-assembly, as described, with the plates held open by struts 34 (FIG. 2) the bracelet strap 14, which is formed with apertures 60, is laid onto the relief section 28 of the base plate, the bushings 40 extending through the apertures 60. The bushings are then cold-rolled outwardly in a head 62 which "rivets" the strap to the clip (FIG. 5). Contemporaneously with the heading of the bushing the frangible struts 34 are sheared so that the cover plate 18 is free to pivot about hinge 20 (FIG. 2).

Figure 2:
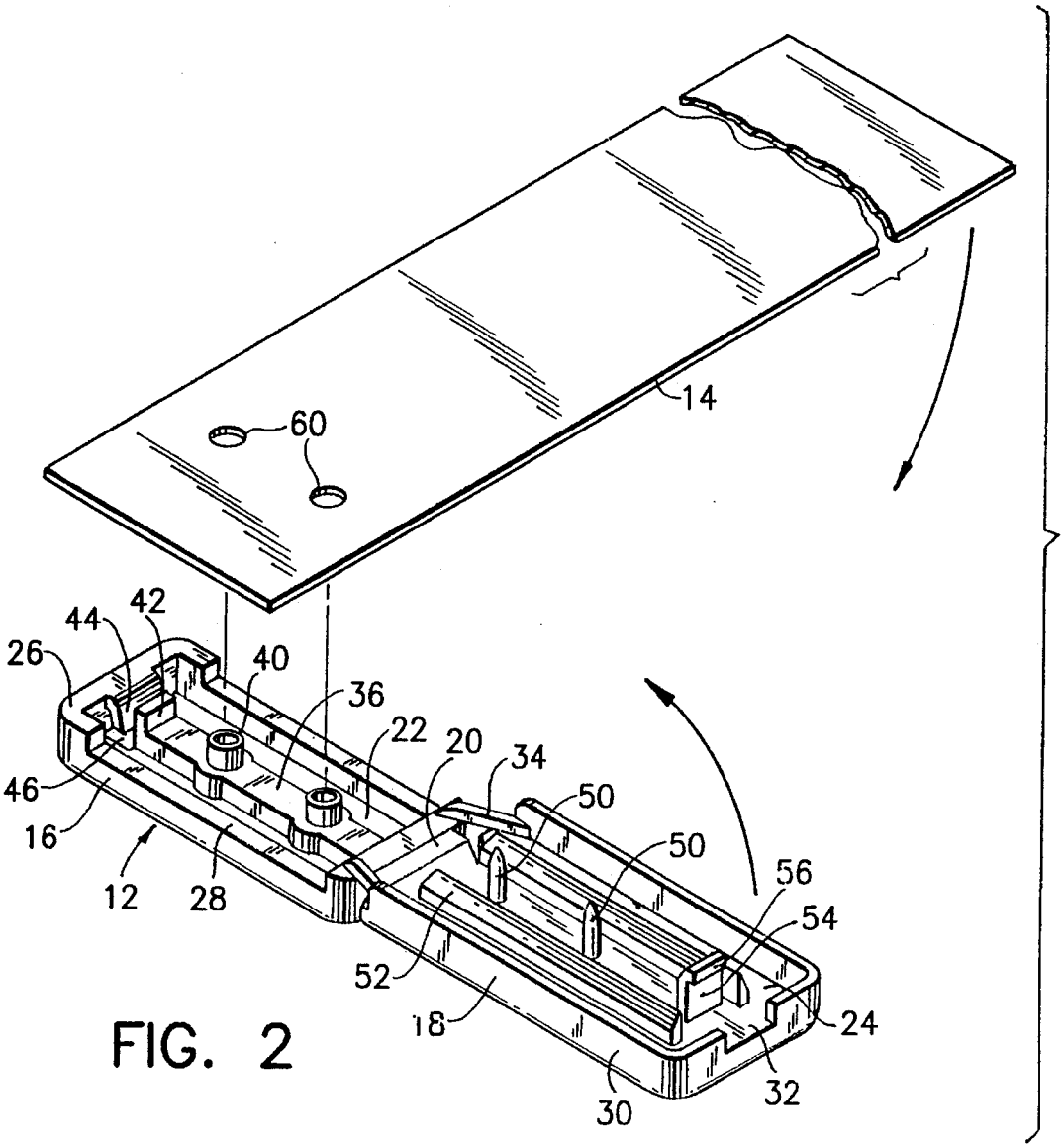
FIG. 2 is a greatly enlarged exploded view of a bracelet of the invention in preassembly.
Figure 3:
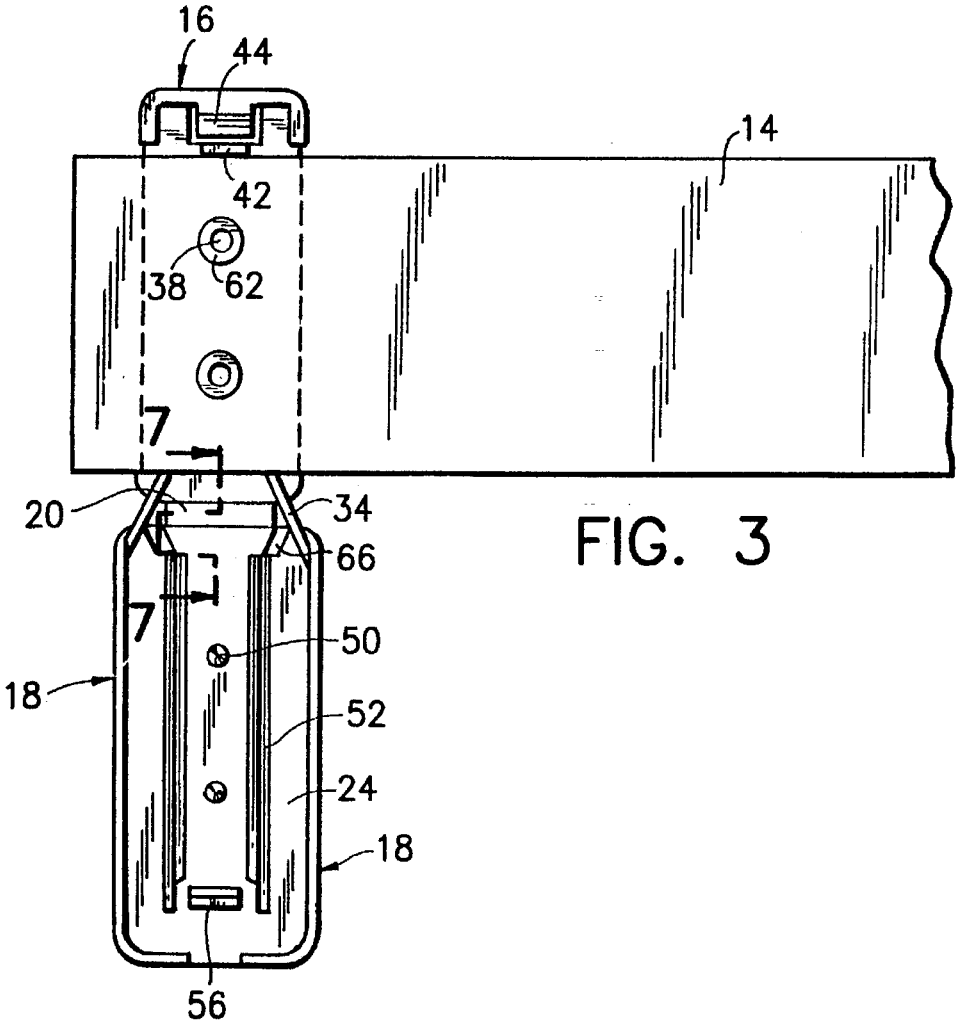
FIG. 3 is a fragmentary view showing the bracelet with preassembly complete except for shearing the hold-open struts.
Figure 4:
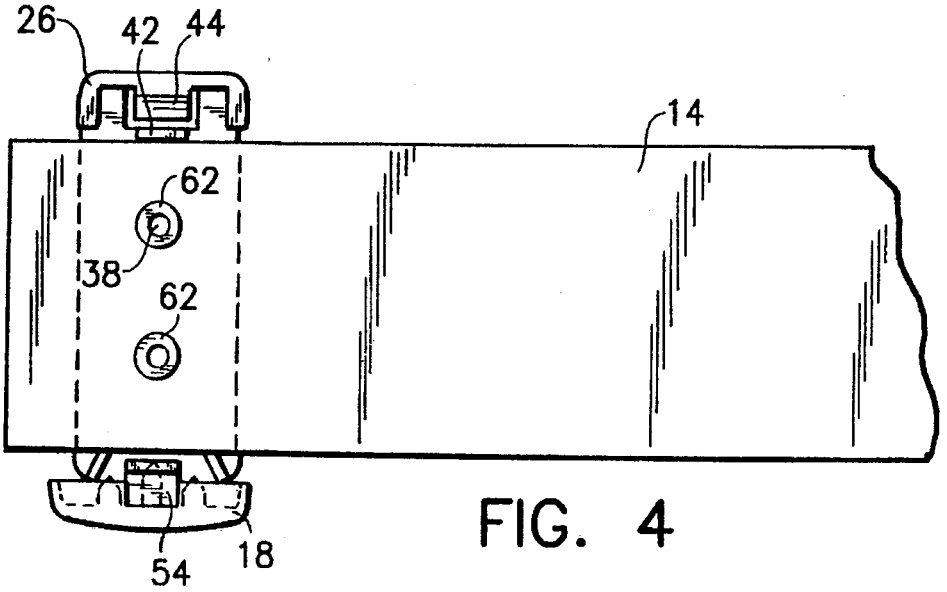
FIG. 4 is a view similar to FIG. 3 with the struts sheared off and the clip plates open at approximate right angles to each other.
Figure 7:
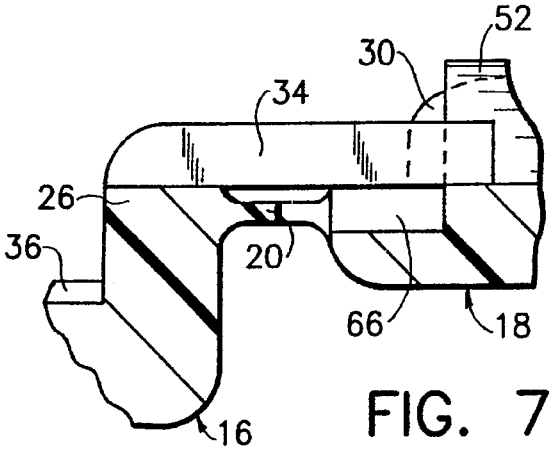
FIG. 7 is a greatly enlarged fragmentary sectional view taken on the line 7—7 of FIG. 3.
Figure 8:
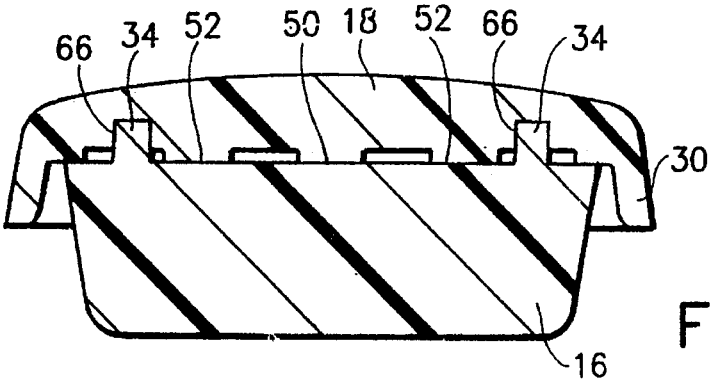
FIG. 8 is a sectional view taken on the line 8—8 of FIG. 5.

In final assembly on the patients' wrist the clip is positioned with the base plate 16 against the patient's skin and the strap 14 encircles the wrist clockwise, as shown in FIG. 2, and the free end is laid into the relief section 28 over the first layer. The cover plate 18 is then manually hinged closed, the pointed projections 50 piercing the free end of the strap and entering the holes 38 at the top of the bushings 40. Finally, the bolt 54 engages the inclined latch 44, is deflected thereby, and the hook 56 snaps past the distal end of the latch permanently snapping the clip closed. It should be noted that recesses 66 (FIGS. 3 and 7) are formed in the cover plate 18 to accommodate the vestiges of the portions of the struts 34 still remaining on the lip 26 adjacent the hinge 20.

If desired or necessary, the remaining free end of the strap 14 may be trimmed adjacent its emergence from the clip.

With the clip thus latched closed (FIG. 6), it should be clear that the ribs 52 having pointed ends assist in clamping the strap, pressing it down firmly toward the inner surface 22 of the base plate and causing the undulations shown in FIG. 6 to grip it better. This augments the holding of the projections 50 which pierce the upper layer as shown.

The invention described here may take a number of forms. It is not limited to the embodiment disclosed but is of a scope defined by the following claim language which may be broadened by an extension of the right to exclude others from making, using or selling the invention as is appropriate under the doctrine of equivalents.

What is claimed is:

1. For an identification bracelet a molded plastic clip comprising rectangular base and cover plates of mutually similar length and width and unitarily formed with a living hinge connecting them endwise, an axis defined along said length of said respective plates, the hinge having an axis perpendicular to said plate axis, the plates each having an inside surface, the inside surfaces confronting each other when the cover plate is pivoted over onto the base plate, one of the plates being formed with openings spaced longitudinally thereof and having bushings on its inside surface about each opening, the other of the plates having pointed projections on its inside surface so spaced as when the cover plate is pivoted over onto the base plate, the projections are capable of piercing a thickness of plastic strap and received respectively by the openings in said one plate, and one of the plates is formed with a bolt extending from its inside surface and having a hook at its distal end, the bolt being remote from the hinge, and the other plate having a cooperant latch opening therein, the latch opening also being remote from the hinge, and at least one strut unitary with the two plates and extending on either side of the hinge and being at an angle to said plate axis and adapted to hold the plates in flat open condition prior to assembly, the strut being readily frangible.

2. A clip as claimed in claim 1 wherein a recess is formed in one of the plates adjacent the hinge to receive a part of the strut after fracture when the clip is closed.

3. A clip as claimed in claim 1 wherein a pair of frangible struts are provided, each of the pair being disposed at an angle to the plate axis.

* * * * *